US005361730A

United States Patent [19]

Clark et al.

[11] Patent Number: 5,361,730

[45] Date of Patent: Nov. 8, 1994

[54] ONE PIECE CYLINDER HEAD AND LINER INCLUDING A DRAFTLESS WATER JACKET

[75] Inventors: Richard J. Clark; Richard K. Clark, both of Gilman; Dennis E. Clark, Onarge, all of Ill.

[73] Assignee: Clark Industries, Inc., Gilman, Ill.

[21] Appl. No.: 183,027

[22] Filed: Jan. 18, 1994

Related U.S. Application Data

[62] Division of Ser. No. 89,109, Jul. 12, 1993, Pat. No. 5,301,423.

[51] Int. Cl.[5] ..... F02F 1/10

[52] U.S. Cl. ..... 123/41.81; 123/65 VC; 123/193.3

[58] Field of Search ..... 123/193.3, 195 R, 41.81, 123/65 A, 65 VC

[56] References Cited

U.S. PATENT DOCUMENTS 1,705,628 3/1929 West ..... 123/41.81
2,108,576 2/1938 Bokemüller ..... 123/65 VC
2,724,372 11/1955 Schowalter ..... 123/65 A
4,446,828 5/1984 Bauder et al. ..... 123/195 R

FOREIGN PATENT DOCUMENTS 3715200 11/1988 Germany ..... 123/193.3

*Primary Examiner*—Noah P. Kamen
*Attorney, Agent, or Firm*—Kajane McManus

[57] ABSTRACT

The unitary cylinder head and liner combination, is vertically cast as a one piece unit. The liner incorporates a water jacket therein. The water jacket is draftless, allowing water to circulate therethrough more efficiently, increasing cooling capabilities. Such vertical one piece casting is made possible by a novel two piece core which eliminates the need for welding of metal bands onto an outer surface of the liner to produce the water jacket thereof. A novel method of vertical casting is also provided which allows the cylinder head to be cast integral with the liner, allows for increased water capacity in the liner and integral head passages, and allows for a plurality of enlarged air intake channels to be provided.

11 Claims, 5 Drawing Sheets

FIG. 1
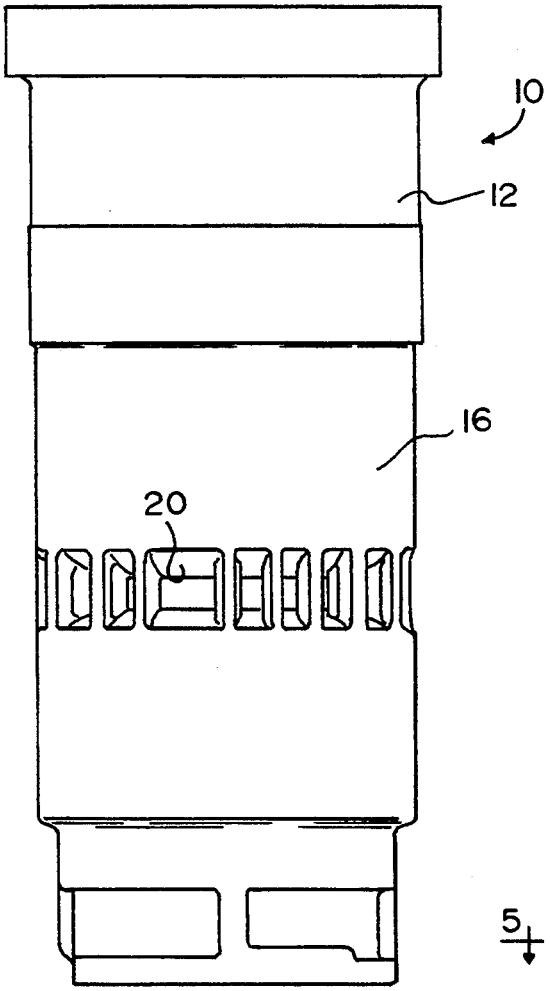
FIG. 3
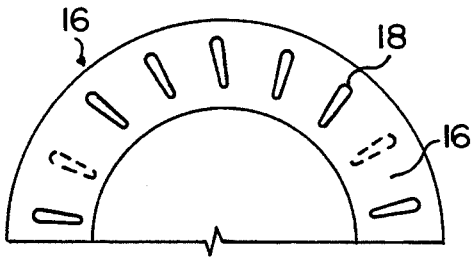
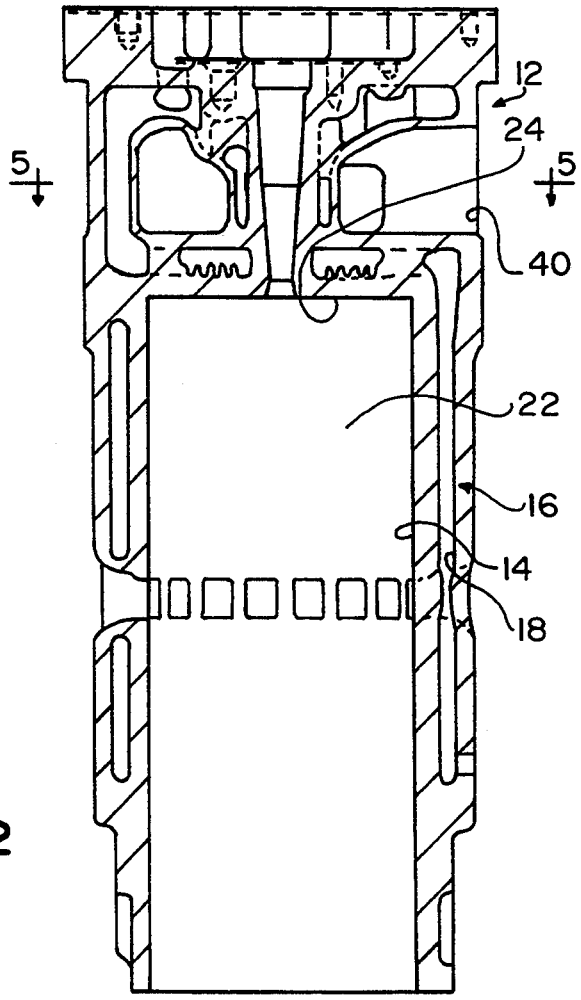
FIG. 2

FIG. 4
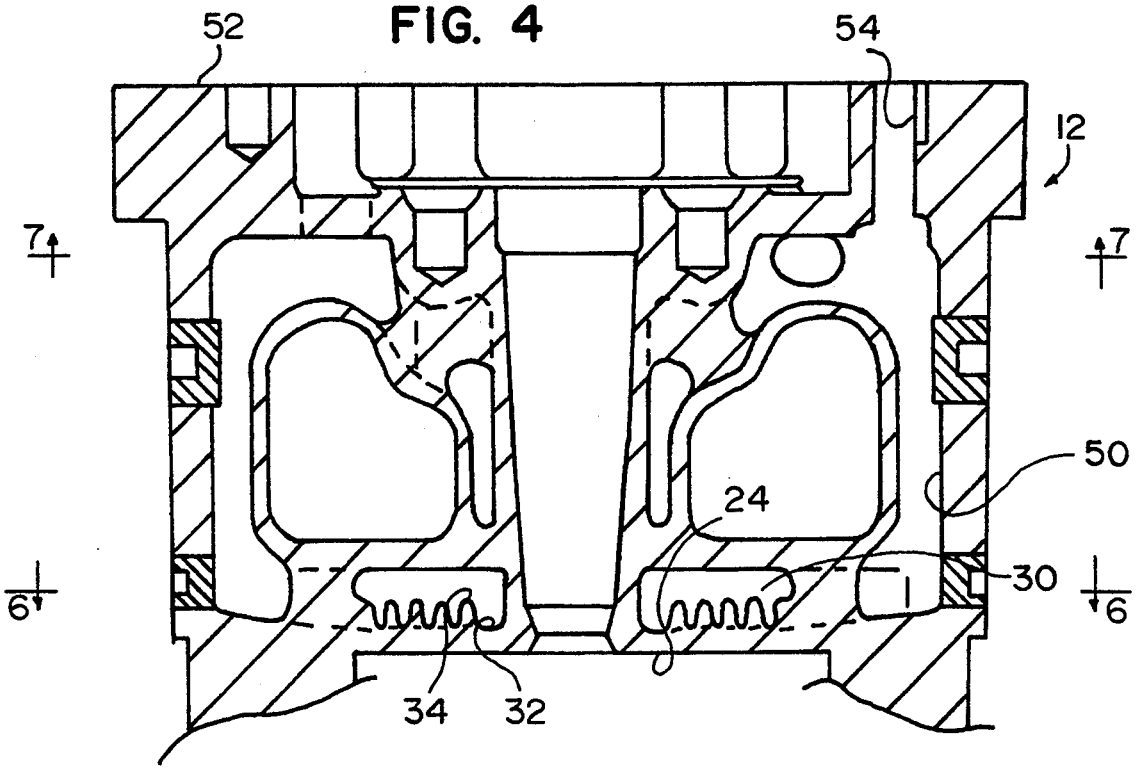
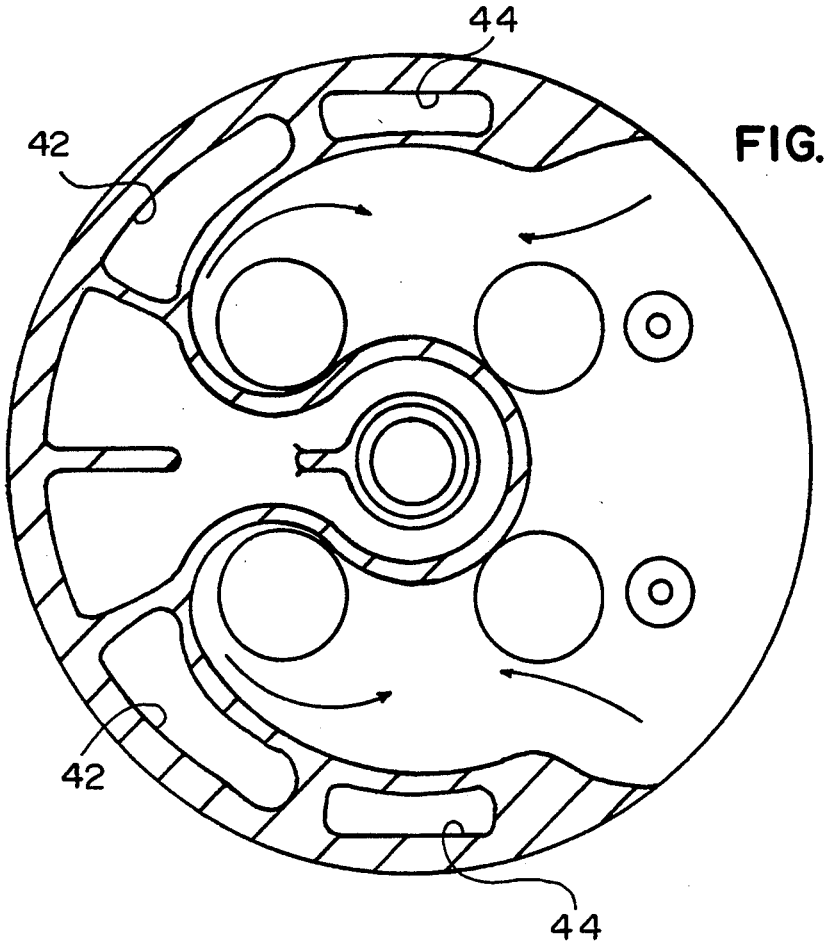
FIG. 5

ONE PIECE CYLINDER HEAD AND LINER INCLUDING A DRAFTLESS WATER JACKET

CROSS REFERENCE TO RELATED APPLICATION

This application is a division of U.S. patent application Ser. No. 08/089,109, filed Jul. 12, 1993, now U.S. Pat. No. 5,301,423, and entitled: One piece Cylinder Head and Liner Including A Draftless Water Jacket And Method For Making Same.

BACKGROUND OF THE INVENTION

1.Field of the Invention

The present invention pertains to a combined cylinder head and liner for an engine, the cylinder liner including a draftless water jacket and the entire structure being of unitary construction. More particularly, the head and liner are formed as a unitary, cast construction and the liner incorporates a draftless water jacket. Such unitary head and liner is created by use of a novel mold and core which allows the structure to be cast vertically, as one piece, without any drafts within the water jacket thereof and with a plurality of enlarged air intakes in the liner.

2. Description of the Prior Art

Heretofore the process for creating a cylinder liner incorporating a water jacket has been a very time consuming, imperfect process yielding a multiple piece unit having drafts in water passages thereof and requiring use of a core of many pieces to yield a liner to the outside of which bands must be welded to create an enclosed water jacket. Also, the liner has been provided with small water and air intake ports. Further, the casting of the liner has necessarily been horizontal, inherently yielding poor concentricity between the inside liner bore and the outside diameter.

Still further, the cylinder head has been necessarily created as a separate structure which must be bolted to the liner, with a gasket interposed therebetween.

As will be described in greater detail hereinafter, the disclosure herein provides a vertical mold within which a one piece cylinder head and liner incorporating a draftless water jacket is vertically molded, creating a structure with an improved concentricity, larger air ports and larger, continuous water paths which are draftless within the water jacket, causing less water swirl and better cooling of the cylinder head and liner.

SUMMARY OF THE INVENTION

Accordingly it is a primary object of the invention to provide a one piece cylinder head and liner incorporating a water jacket.

It is a further object of the invention to provide draftless water paths in the water jacket.

It is still a further object of the invention to provide a mold within which the one piece head and liner may be vertically cast.

It is yet a further object of the invention to provide a cylinder head and liner combination having improved concentricity between the inner liner bore and the outer surface thereof.

It is yet a further object of the invention to provide a liner incorporating significantly larger air intakes.

It is a further object of the invention to provide a method of vertically casting a one piece cylinder head and liner combination incorporating a draftless water jacket and enlarged air intakes.

These and other objects are met by the mold, the method, and the one piece cylinder head and liner combination formed thereby, all of which will be described in greater detail hereinafter.

BRIEF DESCRIPTION OF THE DRAWINGS

FIG. 1 is a perspective view of a one piece cylinder head and liner made in accordance with the teachings of the present invention;

FIG. 2 is a vertical cross sectional view through the head and liner of FIG. 1;

FIG. 3 is a partial transverse cross sectional view through the liner at the level of the air ports therein;

FIG. 4 is an enlarged vertical cross sectional view through the cylinder head portion of the unitary structure of FIG. 2;

FIG. 5 is a transverse cross sectional view through the cylinder head and is taken along line 5—5 of FIG. 2;

DESCRIPTION OF THE PREFERRED EMBODIMENT

Figure 6:
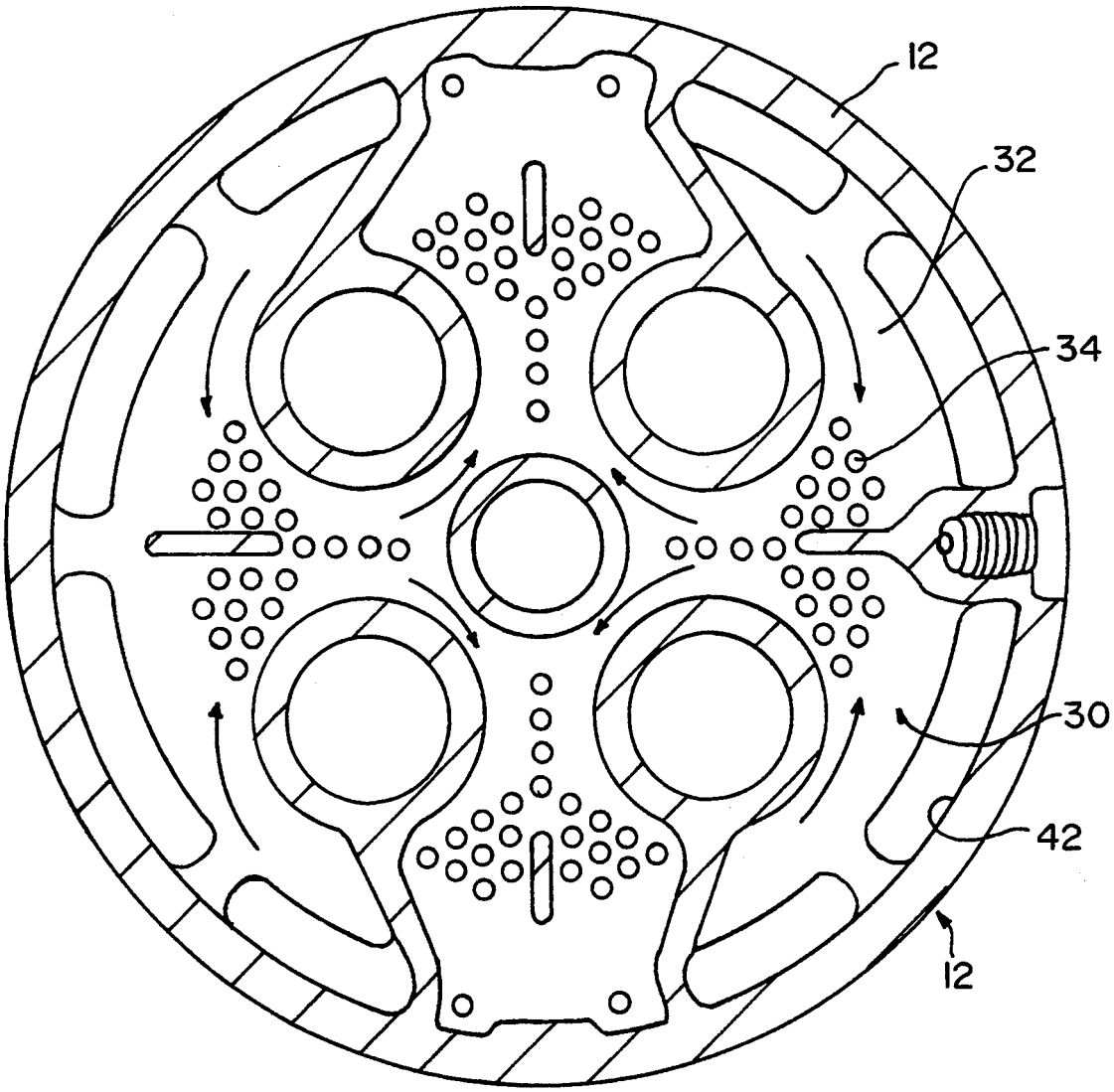
FIG. 6 is a transverse cross sectional view through the cylinder head and is taken along line 6—6 of FIG. 4.

It has heretofore been proposed in applicants' copending application Ser. No. 029,625 to vertically cast a unitary cylinder liner incorporating a draftless water jacket, and the teaching's therein are incorporated herein by reference.

The unitary cylinder head and liner combination 10 of the present invention proposes vertical casting of a cylinder head 12 in combination with a liner 14 described as a unitary structure in applicant's in disclosure.

As stated hereinbefore, a cylinder head has, until now, been cast as an individual structure which is engaged to a cylinder liner by bolting, with a gasket being provided between abutting surfaces of the liner and cylinder head to eliminate potential leakage from this area of juncture.

use of bolts in creating the engagement has required the creation of bores in peripheral areas of the cylinder head and liner, about a circumference of each in the area of the abutment.

Creation of the bores requires that intermittent areas of an outside wall of the cylinder head and liner be thickened to provide a surface into which the bores may extend and by which they may be supported.

Thickening of these intermittent areas inherently limits cooling of the walls of the structures in those areas. Further, smaller water passages must be provided in areas interposed between the thickened areas because space is taken up by the bores, adding further cooling limitations in the area of juncture.

Such cooling limitations cause a bottom surface of the cylinder head to become extremely hot, the increased heat level adversely affecting structural integrity.

Turning now to the drawings incorporated herein, it will be seen that a water jacket 16 incorporated into the liner 14 is now substantially straight walled. Thus, formation of drafts in the water passages 18 thereof has been virtually eliminated, allowing water to pass therethrough without any significant swirl to slow the flow.

Further, because the water passages 18 are significantly enlarged, it has been found that a number of such passages 18 can be eliminated, producing a number of enlarged air ports 20, which increase combustion efficiency within an inner chamber or bore 22 of the liner 14. An upper surface 24 of this chamber 22 is defined by a bottom surface 24 of the cylinder head 12.

The water passages 18 in the water jacket 16 can now continue upwardly into the cylinder head 12, due to the unitary construction.

Here also, the larger water passages 18 can maintain their enlarged configuration because no bolt holes are necessary in the head 12. Thus, greater water flow within the cylinder head 12, and particularly along the bottom surface 24 thereof, can be provided.

As best shown in FIGS. 4–7, a cavity 30 is provided in the bottom area of the cylinder head 12, extending thereacross, adjacent the surface 24.

A bottom surface 32 of this cavity 30 has a significant number of nipples 34 extending upwardly therefrom, creating increased surface area for greater heat transfer from the bottom wall 24 of the cylinder head 12 into the cooling water passing through the cavity 30.

In this respect, combustion takes place within the bore 22 of the liner 14 whenever a piston (not shown) travels upwardly within the bore 22 toward the bottom wall 24 of the cylinder head 12.

Air for combustion is sucked in through the air ports 20 encircling the water jacket 16 as the piston travels within the bore 22, with exhaust gases exiting via an exhaust port 40 in the cylinder head 12, in known manner.

The combustion taking place within the bore 22 inherently generates a significant amount of heat, particularly in the bottom wall 24 of the cylinder head 12. Thus, the need for cooling water to draw heat away from the surface 24 is significant.

It will be seen here that water is now fed from enlarged water input passages 42 spaced about the periphery of bottom surface 32 of the cavity 30, across the cavity 30 and around structures extending thereinto to elongate outlets 44 provided in the upper surface 46 of the cavity 30 at positions opposite one another and interposed between the input passages 42 on the bottom surface 32.

In this respect, water is caused to flow around the various structures extending into the cavity by the interposed and substantially separated outlets 44, the outlets being isolated from the input passages 42 by the structures as well.

Figure 7:
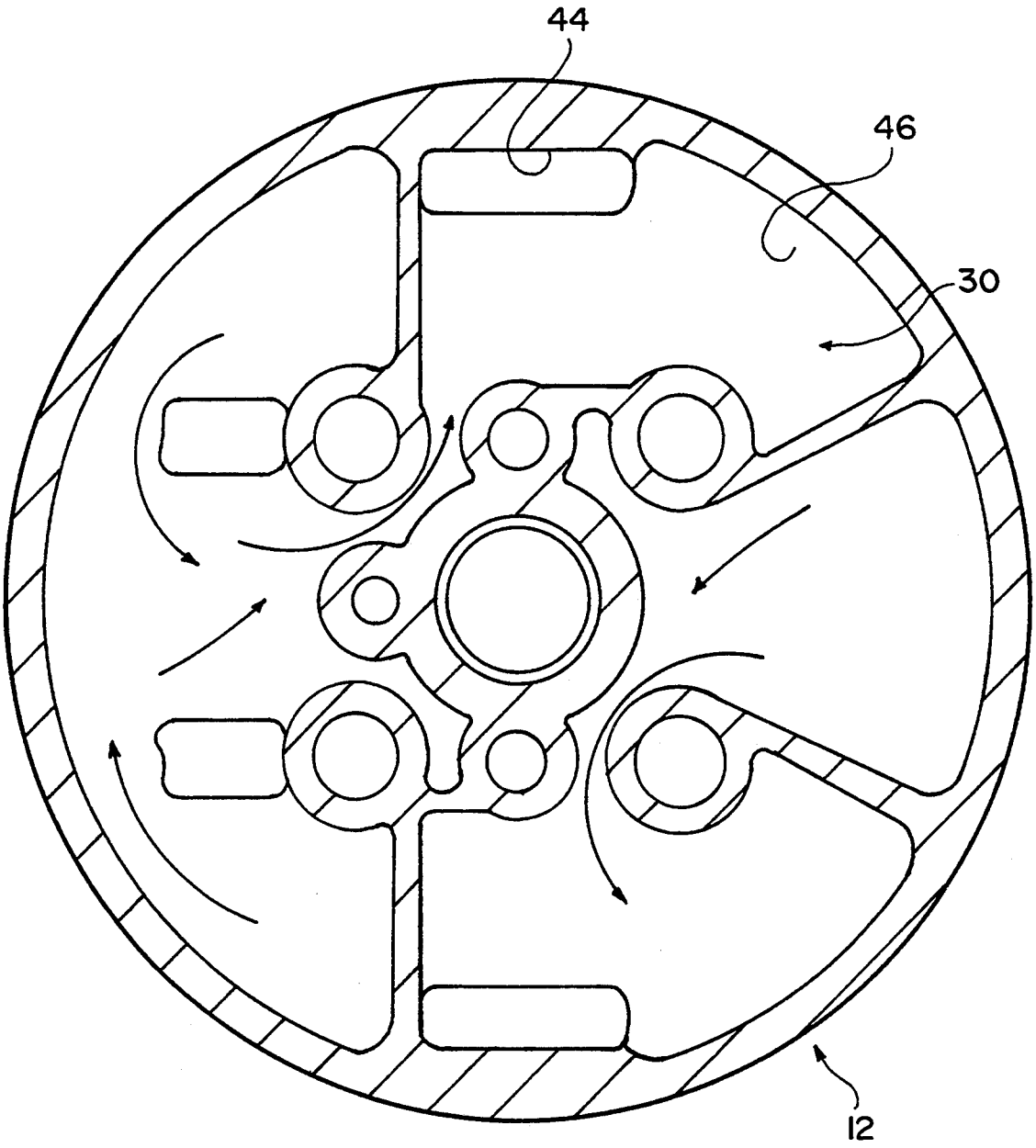
FIG. 7 is a transverse cross sectional view through the cylinder head and is taken along line 7—7 of FIG. 4.

Thus, water flow is created as shown by the arrows in FIGS. 5–7. The water then continues through a peripheral chamber 50 in the cylinder head 12, exiting from a top surface 52 thereof through at least one port 54 therein.

It is the size of the port 54 that governs and controls the rate of flow through the entire cooling system, this port 54 being small now in comparison to the volume of the pathways in the cylinder head 12.

All of the features are easily provided in the unitary cylinder head and liner 10 of the present invention for two reasons. First, the structure 10 is vertically rather than horizontally cast. Second, such vertical casting is only possible because a simple core 82 has been developed as shown in FIG. 8.

Figure 8:
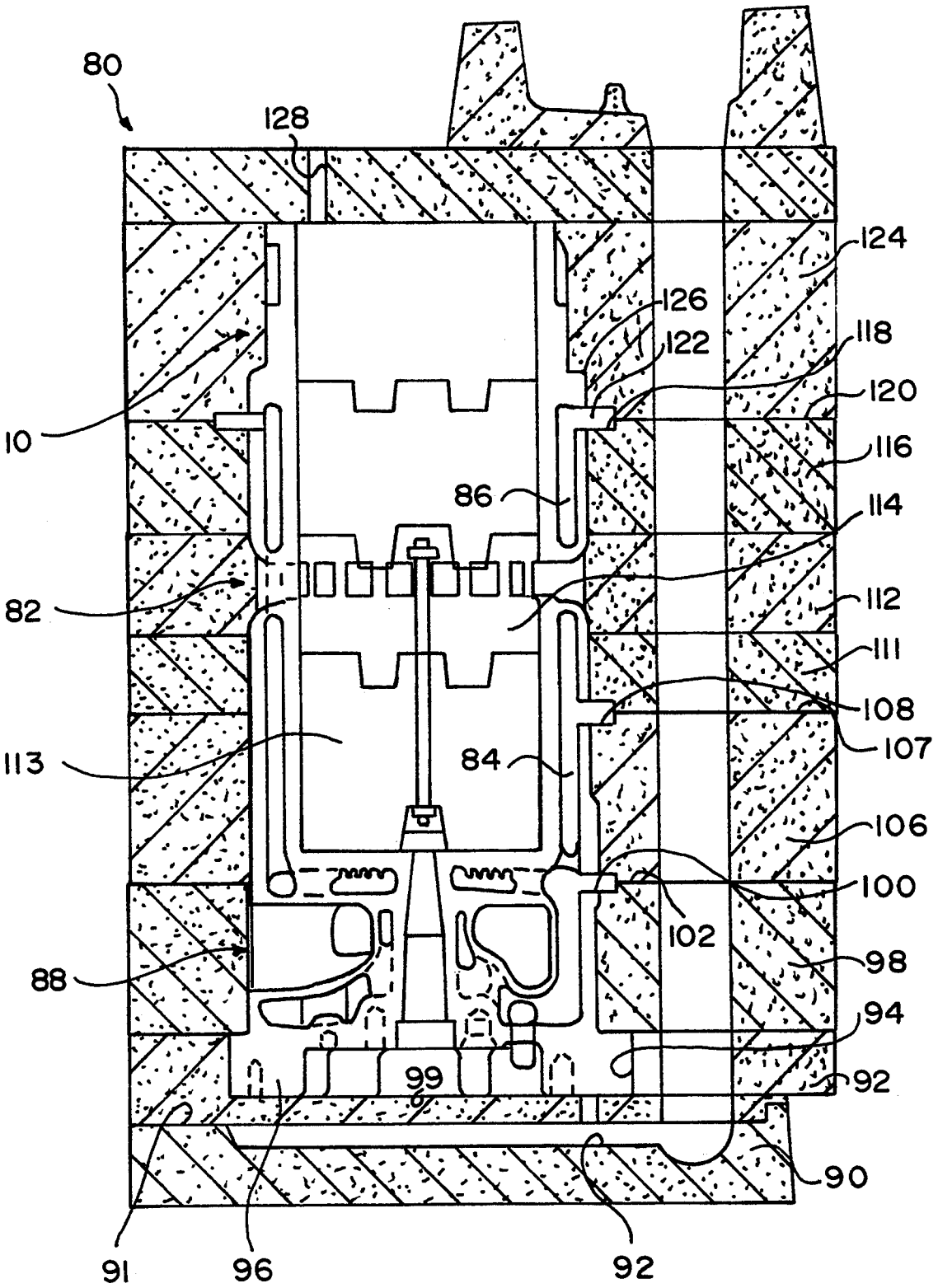
FIG. 8 is a cross sectional view through a vertical mold and core thereof used in creating the unitary cylinder head and liner combination disclosed herein.

It will first of all be understood that the two piece core 82 of the present invention is suspended within the mold 80 shown in FIG. 8, the core being used to create the water passages 12 of the liner 14.

The two piece core 82 includes a substantially cylindrical bottom piece 84 which is suspended within the mold 80 at a predetermined position to form a lower section of the liner water passages 18 and a second upper piece 86 which is suspended in like manner in the mold 80 to form an upper section of the liner water passages 18.

Further, a separate core 88 is provided to create the necessary water passages in the cylinder head 12.

Turning now to FIG. 8, there is illustrated therein a vertical cross section through the mold 80 and cores 82 and 88 thereof which are used to vertically cast the unitary cylinder head and liner 10 of the present invention.

It will be understood that the mold 82 is made up of several sections. The bottom or base section 90 includes a floor 91 within which a plurality of flow paths 92 are cut via which molten metal is introduced upwardly into the mold 82 from a side pour channel 83. The base section 90 is followed by a second section 92 which includes an enlarged hollow 94 which defines a peripheral top lip 96 of the cylinder head 12. Within this section 92 are provided various sections of the core 88 which are used to create the cavities and openings within the head 12 and the upper surface 99 of the cylinder head 12, as have been previously required. Next follows a circular mold portion 98 which has undercut areas 100 in the surface 102 within which support fingers 104 of the core 88 are accommodated, suspending the core 88 a predetermined height above the floor 91 of the mold 80.

Such suspended positioning is necessary so that the molten material can flow below and around the core 82 to create the one piece head and liner 10 having a continuous water passage 18 extending into the head 12. Of necessity, the cores 82 and 88 interact to create the water passages 18 to create the smooth inner bore 22 for the liner 10. A thick walled hollow cylinder shaped mold section 106 is then seated upon mold section 98. It will further be seen that a top surface 107 of the mold section 106 is provided with slots 108 which engage fingers 110 of the bottom piece 84 of the core 82. A round mold section 111 is then seated. An interior mold section 113 is then seated to create surface 24 of the cylinder head 12, and a top surface 24 of bore 22. A round mold section 112 follows and supports a wheel shaped mold section 114.

Next follows a mold section 116 which is similar to section 98, having slots 118 in a top surface 120 thereof within which fingers 122 of core portion 86 rest, suspending core portion 86 over core portion 84 and an interposed rim 123 of the wheel shaped section 114.

A mold section 124 follows which is inwardly stepped in diameter at 126 to create a reduced in outer diameter base of the liner 14.

Next, to create the bottom surface 24 of the head 12, and to create the bore 22 within which the piston travels, center mold sections 132 and 134 are seated within the center hollow 136 above the wheel shaped mold section 114.

Finally, a mold top section 120 having side pour port 122 therein is positioned appropriately and a pour trough 124 having a bore 126 therein which aligns with the pour port 122 engaged. The top section 120 has a plurality of vent ports 128 therein as well.

Molten metal is then poured into the trough 118, flows down through aligned side bores and of the various mold sections and respectively into the channel 92 and flows up and around the core 82, within the confines created by the plurality of mold sections.

Once the poured metal cools, the mold sections, being made of sand, are broken away revealing the one piece cylinder head and liner 10.

Ports 130 produced in the outer sidewall 132 of the liner 10 by the radial fingers of the core pieces 84 and 86 serve as an outlet for the material of the core trapped within the casting. Once the core material has been eliminated from within the castings, the ports 130 may be plugged in any known, suitable manner to produce a smooth outer surface 132 to the one piece liner 10.

As described above, the cylinder head and liner combination 10, and method of the present invention provide a number of advantages, some of which have been described above and others of which are inherent in the invention. Also, modifications may be proposed to the combination 10 and method without departing from the teachings herein. Accordingly, the scope of the invention is only to be limited as necessitated by the accompanying claims.

We claim:

1. A unitary, one piece cylinder head and liner combination, the liner incorporating a draftless water jacket therein, the combination being vertically cast and comprising:

a cylinder head forming portion having a top surface and a bottom surface, a peripheral portion of the bottom surface extending downwardly to form the liner and comprising vertical and concentric inner and outer cylindrical walls;

a lower surface having a ring configuration and joining the walls to one another;

an open area created between the walls serving as the liner water jacket;

the water jacket having an inlet thereto in a bottom area of the outer cylindrical wall, an outlet for the water being provided in the top surface of the cylinder head;

a radial circle of air ports approximately centered along a length of said liner and extending through a full thickness of the liner, said air ports being separated from one another and from the interior open area by walls which are transverse to a center axis of the liner, a plurality of the air ports being significantly enlarged;

the areas between the air ports being hollow to create a complete, continuous water path extending the length of the liner and into the cylinder head.

2. The combination of claim 1 wherein an outer surface thereof is straight along a major portion of the length thereof.

3. The combination of claim 2 wherein an inner bore thereof is straight.

4. The combination of claim 3 wherein said water openings between air ports are of a thickness dimension equal to a thickness dimension of the remainder of the water path.

5. The combination of claim 4 wherein said water openings are shaped to be narrow trapezoids, with a base of the trapezoid facing radially outwardly.

6. The combination of claim 5 wherein said water paths in said liner continue into the cylinder head forming portion.

7. The combination of claim 6 wherein an outer peripheral wall of the cylinder head portion is substantially uniform in thickness.

8. The combination of claim 7 wherein input flow paths in the cylinder head portion are substantially cylindrical in cross section and empty into a cavity extending across the head just above a bottom surface of the head.

9. The combination of claim 8 wherein output flow paths from the cavity are in an upper surface thereof, positioned in between the input flow paths in the bottom surface.

10. The combination of claim 9 wherein the output flow paths are cylindrical in cross section and lead to an output port in the top surface of the cylinder head.

11. A unitary, one piece cylinder head and liner combination, the liner incorporating a draftless water jacket therein, the combination being vertically cast and comprising:

a cylinder head forming portion having a top surface and a bottom surface, a peripheral portion of the bottom surface extending downwardly to form the liner and comprising vertical and concentric inner and outer cylindrical walls;

a lower surface having a ring configuration and joining the walls to one another;

an open area created between the walls serving as the liner water jacket;

the water jacket having an inlet thereto in a bottom area of the outer cylindrical wall, an outlet for the water being provided in the top surface of the cylinder head;

a radial circle of air ports approximately centered along a length of said liner and extending through a full thickness of the liner, said air ports being separated from one another and from the interior open area by walls which are transverse to a center axis of the liner;

the areas between the air ports being hollow to create a complete, continuous water path extending the length of the liner and into the cylinder head.

* * * * *